US010132254B2

(12) United States Patent
Zhang

(10) Patent No.: US 10,132,254 B2
(45) Date of Patent: Nov. 20, 2018

(54) CONTROLLING CAMSHAFT ADJUSTMENT FOR THE COMBUSTION PROCESSES TAKING PLACE IN THE CYLINDERS OF AN INTERNAL COMBUSTION ENGINE

(71) Applicant: Continental Automotive GmbH, Hannover (DE)

(72) Inventor: Hong Zhang, Tegernheim (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 97 days.

(21) Appl. No.: 15/507,417

(22) PCT Filed: Aug. 10, 2015

(86) PCT No.: PCT/EP2015/068341

§ 371 (c)(1),
(2) Date: Feb. 28, 2017

(87) PCT Pub. No.: WO2016/034369

PCT Pub. Date: Mar. 10, 2016

(65) Prior Publication Data

US 2017/0306867 A1 Oct. 26, 2017

(30) Foreign Application Priority Data

Sep. 3, 2014 (DE) ..... 10 2014 217 563

(51) Int. Cl.
*F02D 41/00* (2006.01)
*F02D 41/38* (2006.01)
*F02M 39/02* (2006.01)

(52) U.S. Cl.
CPC ..... *F02D 41/009* (2013.01); *F02D 41/3845* (2013.01); *F02M 39/02* (2013.01);
(Continued)

(58) Field of Classification Search
CPC ..... F02D 41/009; F02D 41/3845; F02D 2200/0602; F02D 2200/0614; F02M 39/02; F01L 2800/09; F01L 2820/041
See application file for complete search history.

(56) References Cited

U.S. PATENT DOCUMENTS

2009/0177366 A1* 7/2009 Achleitner ..... F02D 41/0087 701/103
2010/0269575 A1* 10/2010 Cinpinski ..... F01L 1/185 73/114.41

(Continued)

FOREIGN PATENT DOCUMENTS

DE 10115262 A1 10/2002 ..... F01L 1/34
DE 10341583 A1 4/2005 ..... F01L 1/344

(Continued)

OTHER PUBLICATIONS

German Office Action, Application No. 102014217563.1, 4 pages, dated Jan. 13, 2015.

(Continued)

*Primary Examiner* — Sizo Vilakazi
(74) *Attorney, Agent, or Firm* — Slayden Grubert Beard PLLC

(57) ABSTRACT

The present disclosure relates to internal combustion engines and the teachings thereof may be embodied in methods for controlling an internal combustion engine. The method may include: measuring the actual camshaft position using a camshaft sensor, measuring the actual rail pressure using a rail pressure sensor, calculating, for each of the plurality of cylinders, a phase correction value depending at least in part on the measured actual rail pressure and a mass of fuel to be injected, calculating, for each cylinder, a corrected actual camshaft position based at least in part on the measured actual camshaft position and the respective phase correction value, and adjusting the camshaft position
(Continued)

using a camshaft adjuster based on one or more of the corrected actual camshaft positions.

10 Claims, 2 Drawing Sheets

(52) U.S. Cl.
CPC ..... *F01L 2800/09* (2013.01); *F01L 2820/041* (2013.01); *F02D 2200/0602* (2013.01)

(56) References Cited

U.S. PATENT DOCUMENTS

2011/0232610 A1* 9/2011 Okamoto ..... F02D 41/3863
123/495
2017/0292461 A1* 10/2017 Zhang ..... F02D 41/009

FOREIGN PATENT DOCUMENTS

DE 102005057974 A1 6/2007 ..... F02D 41/00
WO 2016/034369 A1 3/2016 ..... F01L 1/34

OTHER PUBLICATIONS

International Search Report and Written Opinion, Application No. PCT/EP2015/068341, 16 pages, dated Nov. 23, 2015.

* cited by examiner

CONTROLLING CAMSHAFT ADJUSTMENT FOR THE COMBUSTION PROCESSES TAKING PLACE IN THE CYLINDERS OF AN INTERNAL COMBUSTION ENGINE

CROSS-REFERENCE TO RELATED APPLICATIONS

This application is a U.S. National Stage Application of International Application No. PCT/EP2015/068341 filed Aug. 10, 2015, which designates the United States of America, and claims priority to DE Application No. 10 2014 217 563.1 filed Sep. 3, 2014, the contents of which are hereby incorporated by reference in their entirety.

TECHNICAL FIELD

The present disclosure relates to internal combustion engines and the teachings thereof may be embodied in methods and/or devices for improving the combustion processes taking place in the cylinders of an internal combustion engine by controlling camshaft adjustment.

BACKGROUND

Fuel injection systems may include a plurality of cylinders, in each of which a fuel-air mixture is introduced and then ignited. The cylinders may include inlet and outlet valves driven with cams on an inlet valve camshaft or an outlet valve camshaft. The opening and closing times may be set by a control unit in dependence on the camshaft position signal provided by a camshaft sensor.

To determine the mass of air required in each case for the fuel-air mixture, it is typical to use the camshaft position signal provided by the camshaft sensor as an actual position signal for each of the cylinders of the fuel injection system. Furthermore, a setpoint phase shift of the inlet valve camshaft may be calculated on the basis of the setpoint air mass and the engine speed. The phase shift may then be controlled using the camshaft position signal and the setpoint phase shift.

A method for controlling the quantity of air and/or the fuel-air ratio for individual cylinders of an internal combustion engine is taught in DE 10 2005 057 974 A1. In that document, the amplitude and frequency of a signal, which is not cylinder-specific and is influenced by an actuator which is not cylinder-specific, is determined and is used to identify cylinder-specific signal components, and the cylinder-specific signal components are used as the basis for actuating the actuator, which is not cylinder-specific.

Furthermore, some systems drive the high-pressure pump of a fuel injection system using the cams of a camshaft. In such a fuel injection system, if the pressure in the rail and/or the delivery volume of the high-pressure pump increases, then the torque to be provided therefor by the camshaft also increases. This increased increases torsion of the camshaft. In turn, this leads to undesired deviation in the control times of the inlet valves, which is greater the greater the distance of the respective cam from the camshaft sensor. The undesired deviation in the control times in turn affects the quantity of air with which the respective cylinder is filled, and thus also the associated quantity of fuel.

SUMMARY

The teachings of the present disclosure may be embodied in methods and/or devices for improving the combustion processes taking place in the cylinders of an internal combustion engine, which reduce the undesired influences, of pressure changes in the rail and/or of a change in the delivery volume of the high-pressure pump of the internal combustion engine, on the combustion processes taking place in the cylinders.

Some embodiments may include a method for improving the combustion processes taking place in the cylinders of an internal combustion engine having a camshaft, a high-pressure pump driven by the camshaft, a rail and a control unit, having the following steps: measuring the actual camshaft position using a camshaft sensor, measuring the actual rail pressure using a rail pressure sensor, determining, for each cylinder, a phase correction value in dependence on the measured actual rail pressure and the mass of fuel to be injected, determining, for each cylinder, corrected actual camshaft positions by evaluating the measured actual camshaft position and the respective phase correction value, and adjusting the camshaft position using a camshaft adjuster in dependence on one or more corrected actual camshaft positions.

In some embodiments, the adjustment of the camshaft position takes place in dependence on the corrected actual camshaft position of a cam arranged in the central region of the longitudinal direction of the camshaft.

In some embodiments, the adjustment of the camshaft position takes place in dependence on the average value of the corrected actual camshaft positions.

Some embodiments may include measuring the actual intake pipe pressure using a pressure sensor arranged in the intake pipe of the internal combustion engine, and adapting the corrected actual camshaft positions using the measured actual intake pipe pressure.

Some embodiments may include measuring the actual pressure in the cylinders using a pressure sensor arranged in the respective cylinder, and adapting the corrected actual camshaft positions using the actual pressure values measured in the cylinders.

Some embodiments may include a device for improving the combustion processes taking place in the cylinders of an internal combustion engine, which has: a camshaft, a high-pressure pump driven by the camshaft, a rail and a control unit, characterized in that the control unit (10) is designed to carry out the following steps: receiving output signals from a camshaft sensor, describing the actual camshaft position, receiving the output signals from a rail pressure sensor, describing the actual rail pressure, determining, for each cylinder, a phase correction value in dependence on the measured actual rail pressure and the mass of fuel to be injected, determining, for each cylinder, corrected actual camshaft positions by evaluating the measured actual camshaft position and the respective phase correction value, and adjusting the camshaft position using a camshaft adjuster in dependence on one or more corrected actual camshaft positions.

In some embodiments, the control unit (10) is designed to control the adjustment of the camshaft position in dependence on the corrected actual camshaft position of a cam arranged in the central region of the longitudinal direction of the camshaft.

In some embodiments, the control unit (10) is designed to control the adjustment of the camshaft position in dependence on the average value of the corrected actual camshaft positions.

In some embodiments, the control unit (10) is designed to carry out the following further steps: receiving the output signals, describing the actual intake pipe pressure, of a pressure sensor arranged in the intake pipe of the internal combustion engine, and adapting the corrected actual camshaft positions using the measured actual intake pipe pressure.

In some embodiments, the control unit (10) is designed to carry out the following further steps: receiving the output signals, describing the actual pressure in the cylinders, of pressure sensors arranged in the cylinders, and adapting the corrected actual camshaft positions using the actual pressure values measured in the cylinders.

BRIEF DESCRIPTION OF THE DRAWINGS

There follows a description of an exemplary embodiment of the invention with reference to the figures, in which.

DETAILED DESCRIPTION

The teachings of the present disclosure may be used to reduce, in spite of using just one camshaft sensor, the undesired influences, of torsion of the camshaft as a reaction to pressure changes in the rail and/or of a change in the delivery volume of the high-pressure pump, on the combustion processes in the cylinders. Adjusting the camshaft position in dependence on one or more corrected actual camshaft positions may balance the cylinder-specific component of the torque to be provided by the individual cylinders.

This balancing may be conducted such that a cylinder positioned in the central region of the longitudinal direction of the camshaft provides a value, predefined by the control unit, for the cylinder-specific components of the torque to be provided, and the cylinders positioned "left and right" next to this cylinder provide cylinder-specific components that deviate only slightly from the predefined value.

In some embodiments, the adjustment of the camshaft position is adapted by additionally taking into account the measured actual intake pipe pressure and/or by additionally taking into account the actual pressure values measured in the cylinders.

Figure 1:
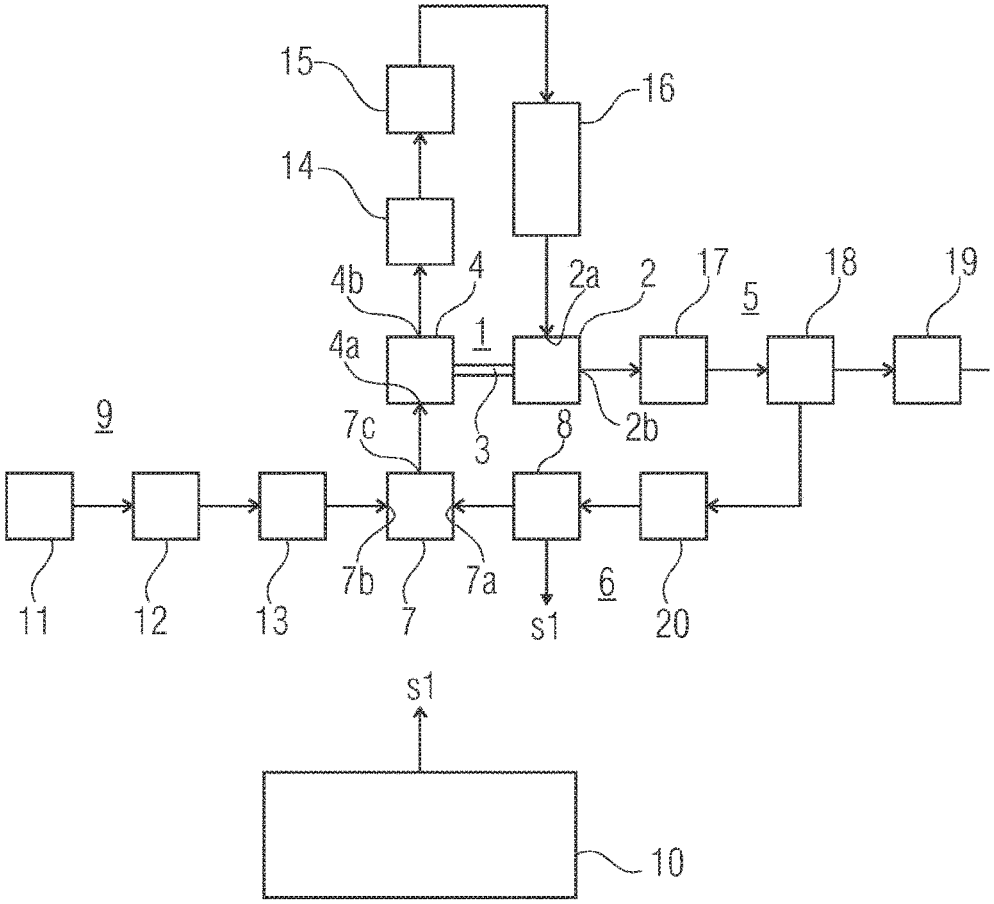
FIG. 1 is a block diagram of a device illustrating an internal combustion engine, according to teachings of the present disclosure.

FIG. 1 shows a block diagram of a device illustrating an internal combustion engine, according to teachings of the present disclosure. The device shown in FIG. 1 has a fresh air inlet duct 9 in which are contained a fresh air inlet 11, an air purification device 12, and an inlet flap 13.

The device shown also has an exhaust gas duct 5 which is connected to the outlet 2*b* of the turbine 2 of an exhaust-gas turbocharger 1. The exhaust gas duct 5 contains a catalytic converter 17, a branching point 18, and a silencer 19. An exhaust gas recirculation duct 6 branches off at the branching point 18. This duct 6 has an exhaust gas cooler 20 and an exhaust gas recirculation valve 8.

The outlet of the exhaust gas recirculation valve 8 is connected to a first inlet 7*a* of a mixer 7. The outlet of the inlet flap 13 of the fresh air inlet duct 9 is connected to the second inlet 7*b* of the mixer 7.

The outlet 7*c* of the mixer 7 is connected to the inlet 4*a* of a compressor 4 of the exhaust-gas turbocharger. The compressor 4 has a compressor rotor which is secured in rotation with a shaft 3 which is also secured in rotation with a turbine rotor of the turbine 2.

The exhaust gases of an internal combustion engine 16, in the form of an exhaust gas stream, enter at the inlet 2*a* of the turbine. This exhaust gas stream drives the turbine rotor. This also rotates the shaft 3 of the exhaust-gas turbocharger 1. This rotation of the shaft is transmitted to the compressor rotor.

The compressor draws in and compresses the fresh air/exhaust gas mixture created in the mixer 7 and supplied to the inlet 4*a* of the compressor. The compressed fresh air/exhaust gas mixture is expelled at the outlet 4*b* of the compressor and is supplied, via a charge air cooler 14 and a throttle flap 15, to the internal combustion engine 16. As already explained above, the exhaust gas created in the internal combustion engine is expelled at the inlet 2*a* of the turbine 2.

The device shown in FIG. 1 also has a control unit 10 which contains a processing unit and multiple memory units in which tables and characteristic diagrams may be stored. The output signals from a multiplicity of sensors, which supply the control unit with actual values of a multiplicity of parameters, may be supplied to the control unit 10 as input signals. These include, inter alia, a sensor which detects actuation of the accelerator pedal. The output signals from this sensor tell the control unit 10 that there is a desire for acceleration. Also included is a sensor which provides the control unit 10 with information relating to the actual intake pipe pressure. This sensor may be positioned between the outlet of the throttle flap 15 and the internal combustion engine 16. Additional sensors may provide information relating to the actual pressure in the cylinders of the internal combustion engine 16.

The control unit 10 evaluates the output signals from the sensors, the saved tables, and the saved characteristic diagrams to calculate control signals which are used to actuate components of the device shown. Inter alia, the control unit 10 calculates control signals s1 for the exhaust gas recirculation valve 8 and transmits these thereto. These control signals s1 cause the opening state of the exhaust gas recirculation valve 8 to change, depending on the immediate requirement, to supply more or less exhaust gas to the mixer 7.

Figure 2:
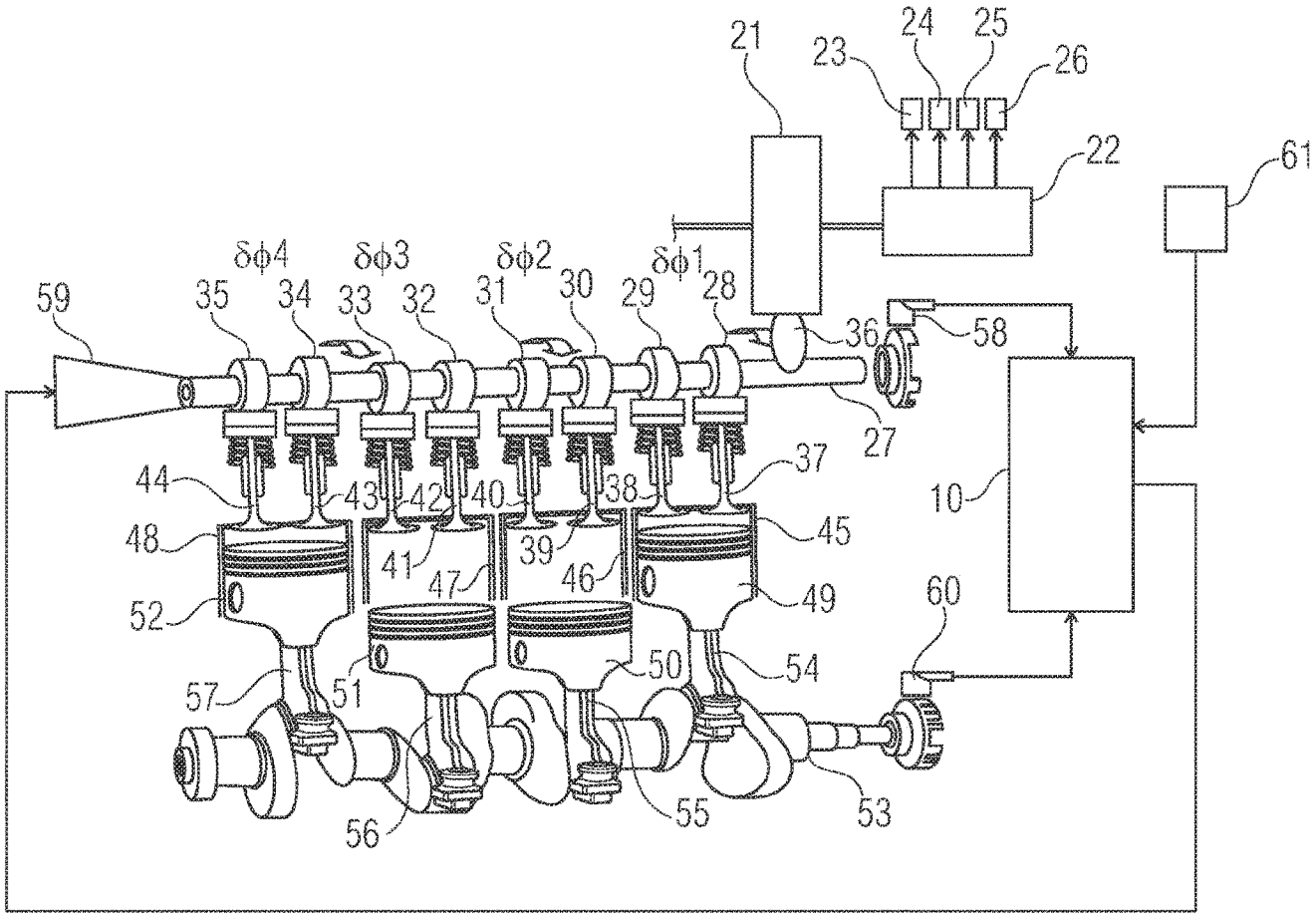
FIG. 2 is a more detailed illustration of parts of the device shown in FIG. 1.

Furthermore, the control unit 10 determines the air mass of the internal combustion engine 16 on an individual cylinder basis, and uses the air mass determined for each cylinder to determine a respective associated fuel injection mass. Furthermore, the control unit 10 is designed such that it controls an adjustment of the camshaft position in dependence on one or more corrected actual camshaft positions. This is explained in greater detail below with reference to FIG. 2, which shows a more detailed illustration of parts of the device shown in FIG. 1. In particular, FIG. 2 shows additional components of the fuel injection system of the internal combustion engine 16.

These include a high-pressure pump 21, a rail 22 connected to fuel injectors 23, 24, 25 and 26, a camshaft 27 that bears cams 28-36, inlet valves 37-44, a total of four cylinders 45-48 in each of which a piston 49-52 can be moved up and down, and a crankshaft 53 connected to the pistons by connecting rods 54-57.

Also included are the control unit 10, shown in FIG. 1, and a camshaft sensor 58, a camshaft adjuster 59, a crankshaft sensor 60, and sensors 61 whose output signals are supplied to the control unit 10. These sensors may include, inter alia, a rail pressure sensor, an intake pipe pressure sensor, and pressure sensors arranged in the cylinders.

The high-pressure pump 21 may be engaged to raise the pressure of the supplied fuel, and to forward the high-pressure fuel to the rail 22. From the rail 22, the fuel is supplied to the injectors 23, 24, 25, 26 which each inject the fuel into one of the cylinders 45-48. In that context, the control unit 10 controls the quantity of fuel and the injection times. The high-pressure pump 21 may be driven, via the cams 36, by the rotating camshaft 27. An increase in the pressure of the fuel in the rail 22 and/or in the delivery volume of the high-pressure pump 21 causes further torsion of the camshaft.

This increase in the pressure of the fuel in the rail and/or of the delivery volume of the high-pressure pump 21 also means that the cylinder-specific component of the torque that is to be provided varies substantially from cylinder to cylinder.

To avoid these drawbacks, cylinder-specific phase correction values 601, 602, 603, and 604 may be used. These may be determined in dependence on the actual rail pressure measured by a rail pressure sensor, and on the quantity of fuel to be injected, predetermined by the control unit 10. For each individual cylinder, the determined phase correction values may be added by the control unit 10 to the camshaft position measured by the camshaft sensor 58. The corrected cylinder-specific actual camshaft positions, determined by this adding step, may be used to adjust the camshaft position by means of the camshaft adjuster 59.

One embodiment involves this adjustment of the camshaft position taking place in dependence on the corrected actual camshaft positions of a cam arranged in the central region of the longitudinal direction of the camshaft. In the embodiment shown in FIG. 2, the cam arranged in the central region of the longitudinal direction of the camshaft may be cam 31 or cam 32. The control unit 10 determines, from the corrected actual camshaft position of the cam 31 or 32, a cylinder-specific component of the torque to be provided by the cylinder 46 or 47 associated with this cam, such that this component corresponds to the average value of the components of all the cylinders 45-48. In the embodiment shown, in which there are provided a total of four cylinders, the component of the torque to be supplied by each of the cylinders 46 and 47 can for example be 25%, the component for cylinder 45 can for example be 26%, and the component for cylinder 48 can for example be 24%. Some embodiments include the adjustment of the camshaft position based on the average value of the corrected actual camshaft positions.

As described above, there is only a minor difference in the components of the torque to be supplied by the cylinders. This balancing of the torque components to be provided by the cylinders permits exact provision of the required average torque and avoids a larger variation in the torques generated at the cylinders.

To further adjust of the camshaft position, the actual intake pipe pressure may be measured using a pressure sensor arranged in the intake pipe of the internal combustion engine. The measured actual intake pipe pressure is used to adapt the corrected actual camshaft positions.

As an alternative or in addition thereto, the camshaft position can be adjusted by measuring the actual pressure in the cylinders using a pressure sensor arranged in the respective cylinder and by adapting the corrected actual camshaft positions using the actual pressure measured in the cylinders. The above-described method may also adapt the quantity of fuel of the respective cylinder to the quantity of air of the respective cylinder, and thus improve the combustion processes taking place in the cylinders.

What is claimed is:

1. A method for controlling an internal combustion engine having a plurality of cylinders, a camshaft, a high-pressure pump driven by the camshaft, and a rail, the method including:

measuring the actual camshaft position using a camshaft sensor, measuring the actual rail pressure using a rail pressure sensor, calculating, for each of the plurality of cylinders, a phase correction value depending at least in part on the measured actual rail pressure and a mass of fuel to be injected, calculating, for each cylinder, a corrected actual camshaft position based at least in part on the measured actual camshaft position and the respective phase correction value, and adjusting the camshaft position using a camshaft adjuster based on one or more of the corrected actual camshaft positions.

2. The method as claimed in claim 1, wherein adjusting the camshaft position depends on the corrected actual camshaft position of a cam arranged in the central region along a longitudinal direction of the camshaft.

3. The method as claimed in claim 1, wherein adjusting the camshaft position depends on an average value of the corrected actual camshaft positions.

4. The method as claimed in claim 1, further comprising:

measuring an actual intake pipe pressure using a pressure sensor arranged in an intake pipe of the internal combustion engine, and calculating, for each cylinder, the corrected actual camshaft position based at least in part on the measured actual intake pipe pressure.

5. The method as claimed in claim 1, further comprising:

measuring an actual pressure in each of the plurality of cylinders using a pressure sensor arranged in the respective cylinder, and adapting the corrected actual camshaft positions using the actual pressure values.

6. An internal combustion engine comprising:

a camshaft with a camshaft position sensor;

a high-pressure pump driven by the camshaft;

a rail with a rail pressure sensor;

a plurality of cylinders; and a control unit:

receiving output signals from the camshaft position sensor representing an actual camshaft position, receiving output signals from a rail pressure sensor representing an actual rail pressure, calculating, for each cylinder, a phase correction value based at least in part on the actual rail pressure and a mass of fuel to be injected, calculating, for each cylinder, a corrected actual camshaft position based in part on the measured actual camshaft position and the respective phase correction value, and adjusting the camshaft position using a camshaft adjuster based at least in part on one or more corrected actual camshaft positions.

7. The device as claimed in claim 6, wherein the control unit controls the adjustment of the camshaft position based on the corrected actual camshaft position of a cam arranged in a central region along a longitudinal direction of the camshaft.

8. The device as claimed in claim 6, wherein the control unit controls the adjustment of the camshaft position based on an average value of the corrected actual camshaft positions.

9. The device as claimed in claim 6, wherein the control unit:

receives output signals representing an actual intake pipe pressure from a pressure sensor arranged in an intake pipe of the internal combustion engine, and adapts the corrected actual camshaft positions using the measured actual intake pipe pressure.

10. The device as claimed in claim 6, wherein the control unit:

receives output signals representing an actual pressure in the cylinders from pressure sensors arranged in the cylinders, and adapting the corrected actual camshaft positions using the actual pressure values measured in the cylinders.

* * * * *